US005435039A

United States Patent [19]

Taylor

[11] Patent Number: 5,435,039

[45] Date of Patent: Jul. 25, 1995

[54] SCALP STIMULATION AND CLEANSING IMPLEMENT

[76] Inventor: Robert B. Taylor, 65 Brookwood Rd., Asheville, N.C. 28804-1631

[21] Appl. No.: 246,160

[22] Filed: May 19, 1994

[51] Int. Cl.[6] ..... A47K 7/00

[52] U.S. Cl. ..... 15/210.1; 15/244.1

[58] Field of Search ..... 15/107, 110, 104–105, 15/210.1, 211, 212, 231, 233, 244.1

[56] References Cited

U.S. PATENT DOCUMENTS

| | | | |
|---|---|---|---|
| 126,945 | 5/1872 | Finn . | |
| 902,881 | 11/1908 | Holland | 15/212 |
| 1,127,244 | 2/1915 | Helstrom . | |
| 1,407,102 | 2/1922 | Viden | 15/233 |
| 1,922,450 | 8/1933 | O'Brien | 15/244.1 |
| 2,871,497 | 2/1959 | Miller et al. | 15/244.1 |
| 2,955,308 | 10/1960 | Nelson . | |
| 3,061,861 | 11/1962 | Hartmann | 15/244.1 |
| 3,164,853 | 1/1965 | Peeler . | |
| 3,220,040 | 11/1965 | Knaebe | 15/244.1 |
| 3,262,459 | 7/1966 | Sheehan | 15/244.1 |
| 3,389,418 | 6/1968 | Sencabaugh | 15/244.1 |
| 3,391,026 | 7/1968 | Leiser | 15/211 |
| 3,568,235 | 3/1971 | Aston . | |
| 3,568,237 | 3/1971 | Rhodes . | |
| 3,717,898 | 2/1973 | Jones . | |
| 4,619,014 | 10/1986 | Piken . | |
| 4,827,556 | 5/1989 | Corsetti | 15/210.1 |

FOREIGN PATENT DOCUMENTS

| | | | |
|---|---|---|---|
| 536773 | 4/1955 | Belgium | 15/244.1 |
| 559728 | 6/1923 | France . | |
| 723815 | 1/1932 | France . | |
| 191846 | 1/1923 | United Kingdom | 15/233 |
| 1340949 | 12/1973 | United Kingdom | 15/244.1 |

*Primary Examiner*—Timothy F. Simone
*Assistant Examiner*—Tony G. Soohoo
*Attorney, Agent, or Firm*—Bell, Seltzer, Park & Gibson

[57] ABSTRACT

An implement for stimulation and cleansing of the scalp. An elongate, flexible handle formed by a pair of wire stems extending from a coil is provided. Scalp stimulation tips extend from the ends of the wire stems for being engaged on the scalp beneath a hairpiece. A cleansing pad is slidably mounted on the wire stems for cleansing the scalp. The cleansing pad may be moved between each end of the handle, so as to obscure the stimulation tips for cleansing without stimulation, or moved behind the tips for simultaneous cleansing and stimulation, or still further moved to the far end of the handle for scalp stimulation only.

19 Claims, 1 Drawing Sheet

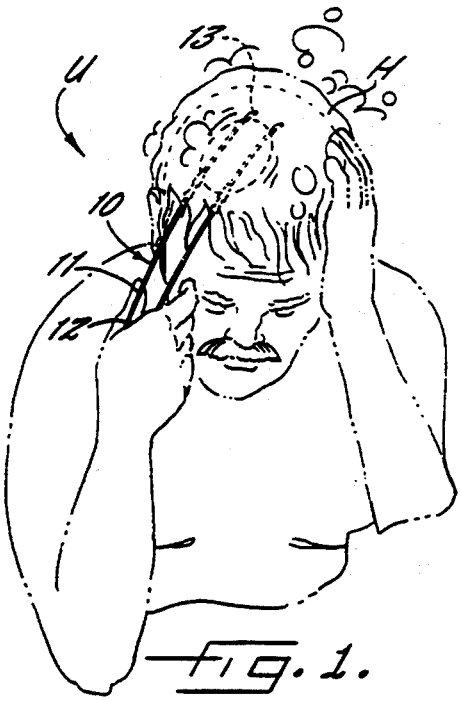
Fig. 1.
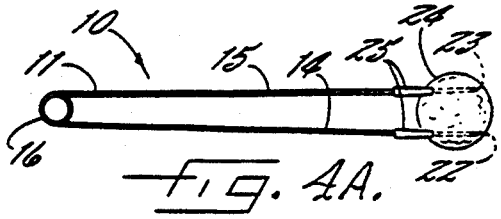
Fig. 4A.
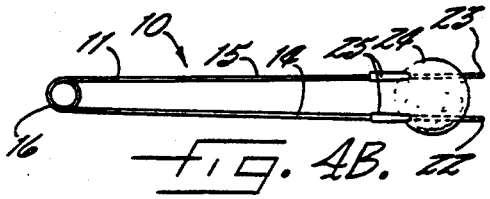
Fig. 4B.
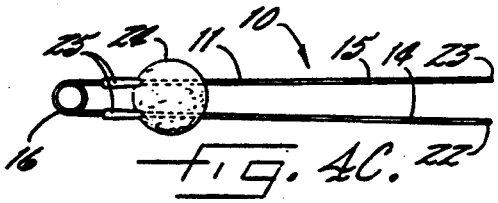
Fig. 4C.
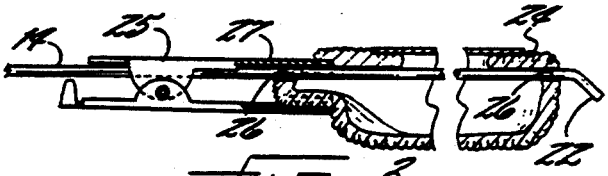
Fig. 3.
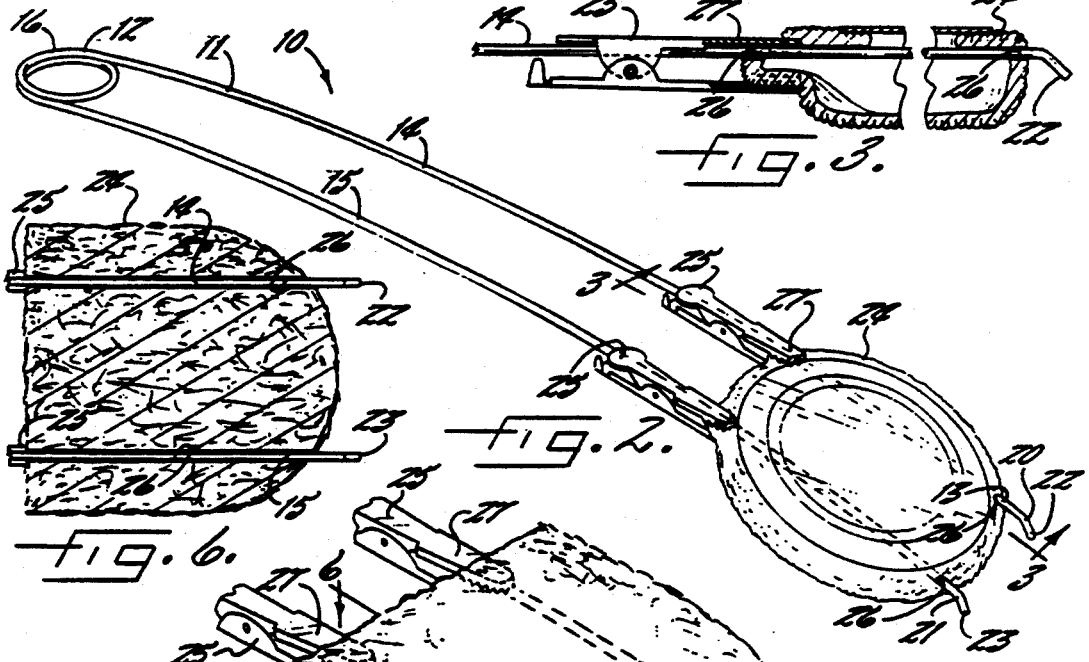
Fig. 2.
Fig. 6.
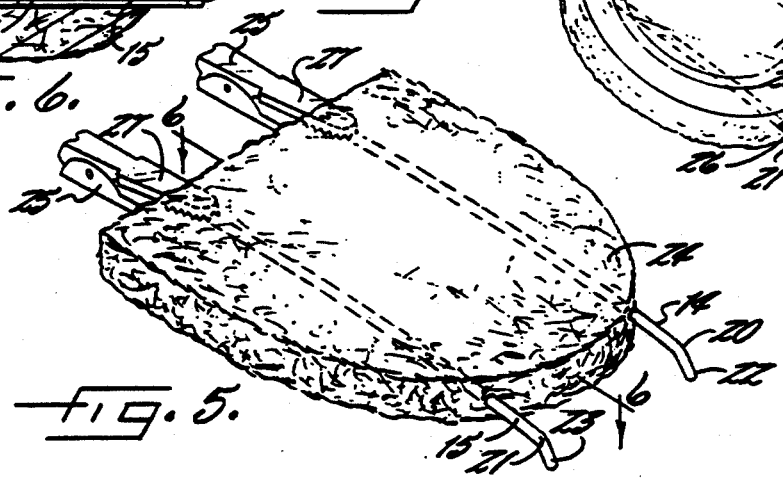
Fig. 5.

SCALP STIMULATION AND CLEANSING IMPLEMENT

FIELD OF THE INVENTION

The invention relates to an apparatus for stimulating and cleansing the scalp underlying a hairpiece. In particular, the invention relates to an implement for reaching underneath a hairpiece that is tightly affixed to the scalp of a user for stimulating and cleansing the scalp.

BACKGROUND OF THE INVENTION

In recent years, hairpieces, including hair replacements or other artificial hair appliances, have become increasingly popular, particularly among balding men, for enhancing an individual's aesthetic appearance. Hair replacements, in which a mesh of hair is affixed to the head by being attached to existing, genuine hair and/or skin around the fringes of one's scalp, have been found to provide a desirable aesthetic appearance and offer convenience for the user. Varying methods of attachment are used, including, but not limited to, use of bonding materials, adhesive taped or sewing/weaving of the hairpiece to existing hair.

Since hair replacements are attached to existing hair and/or skin, they have the advantage of remaining tightly affixed to the head, so as to closely overlie the scalp, thus providing a secure, natural appearance in all weather conditions and under a wide range of activities. However, hair replacements must be periodically tightened from time to time by adjustment of the attachment means which anchor the hair replacement to the user's existing living hair. This requirement arises from growth of the user's existing hair, which allows the hair replacement to loosen from the scalp. This is particularly noticeable in hairpieces that are affixed to a closely shaved portion of the user's hair, which, due to hair growth, must be tightened about every 5–8 weeks.

One disadvantage of hair replacements is that they cannot be readily removed to allow easy access of a user's hand or other implement for cleansing or stimulation of the scalp, or to allow needed air ventilation over the scalp. It has been found difficult to clean the scalp underlying the hair replacement since special effort is needed to reach under the hair replacement to engage the scalp mechanically. Further, since the hair replacement remains closely stretched over the scalp for long periods of time, it is common that the scalp frequently suffers irritation over time, such that itching or other discomforts develop. Relief from such irritation is especially problematic near the fringes of the hair replacement, where the replacement is affixed to existing hair.

One prior attempt to solve the problem of cleansing the scalp underlying a hair replacement appliance is shown in U.S. Pat. No. 4,619,014, issued to Piken on Oct. 28, 1986, entitled "Scalp Cleaner." The scalp cleaner shown in the Piken '014 patent has a flexible, thin handle with a cleaning member such as a sponge affixed to one end. The sponge may be inserted between the hairpiece and the scalp for cleansing. However, while the scalp cleaner shown in the Piken '014 patent provides for cleansing, it has not adequately solved the problem of relieving itching or other discomfort commonly experienced by wearers of hairpieces, and it has not satisfactorily solved the problem of cleansing the scalp underlying the hairpiece, especially in hard to reach fringe areas of the scalp. Also, it is believed that the Piken '014 cleaner cannot easily be inserted under a newly-tightened hairpiece without risk of stretching the hairpiece or loosening the attachment means which hold the hairpiece in place on the scalp, especially during the first few weeks following a tightening.

In light of the aforementioned deficiencies, it is an object of the present invention to provide a new apparatus for stimulating the scalp underlying a hairpiece to relieve itching or other discomfort.

Another object of the present invention is to provide an apparatus for stimulating the scalp underlying a hairpiece and further for cleansing the scalp.

A further object of the present invention is to provide an apparatus for cleansing and/or stimulating the scalp that is particularly suited for use beneath a recently-tightened hairpiece.

A still further object of the present invention is to provide an apparatus for simultaneous stimulation and cleansing of the scalp underlying a hairpiece.

Yet another object of the present invention is to provide an apparatus for stimulating and cleansing the scalp of a user underlying a hairpiece and which is sufficiently long and flexible for conforming to the shape of the scalp so as to extend to remote portions of the scalp underlying the hairpiece for stimulation and cleansing.

Still another object of the present invention is to provide an apparatus for stimulating and for cleansing the scalp near the edges of a hair replacement.

SUMMARY OF THE INVENTION

The above and other objects and advantages of the present invention are achieved in the embodiments described herein by the provision of a scalp stimulating and cleansing implement having an elongate, flexible handle having first and second ends. A plurality of scalp stimulation tips extend transverse to the handle at the first end. The second end of the handle is suitable for manual grasping by the hand of a user. Preferably, the transverse tips are oriented so that they extend substantially downwardly when the implement is held by a user so that the handle is substantialy horizontal, so as to engage the scalp.

In one preferred embodiment, a wire coil is located at the second end of the handle from which a plurality of laterally spaced apart, elongate wire stems extend. The elongate wire stems may be substantially parallel or slightly divergent as they extend from the coil. Each wire stem has a free end which defines the first end of the handle from which the scalp stimulation tips may be formed by bent portions of the wire stems. The tips may be about ⅛ inch long at an angle of about 45° relative to the wire stems.

Two such wire stems may be used. The wire stems may be grasped by a user to manipulate the implement between a hairpiece and the scalp so as to engage the stimulation tips on the scalp for relieving itching or other discomfort. A scalp cleansing pad may also be received on the handle. The cleansing pad is preferably substantially flat, and may be semi-circular or circular in shape. The pad may be made of cloth, a fibrous material such as a polyester fiber sponge, foam sponge, or other suitable material, which should preferably be absorbent. Other shapes and materials may also be used for the pad. The pad may also be made of multiple plies of materials.

In a preferred embodiment, the scalp cleansing pad is slidably and removably received on the wire stems. Accordingly, means are provided for slidably affixing the scalp cleansing pad to the wire stems. The affixing means may include a plurality of perforations within the pad for slidably receiving the wire stems. Clips, such as alligator clips or the like, may also be provided for engaging an edge of the pad and further securing the pad to the wire stems. The clips may be slidably received on the wire stems or may be removably mounted on the wire stems.

The cleansing pad may be positioned as desired by sliding along the wire stems. If desired by the user, the pad may be positioned near the first end of the handle, at the free ends of the wire stems and the stimulation tips, so as to conceal the stimulation tips when scalp cleansing but not stimulation is desired. Alternatively, the cleansing pad may slide to a position intermediate the first and second ends of the handle, between the stimulation tips and the wire coil, and slightly behind the stimulation tips, so as to expose the stimulation tips for simultaneous scalp cleansing and stimulation. As yet another alternative, the cleansing pad may be slidably moved toward the second end of the handle, near the wire coil, so that the stimulation tips may be engaged on the scalp but so that the cleansing pad will not contact the scalp when scalp stimulation without scalp cleansing is desired. The scalp cleansing pad may also be removed if its use is unnecessary, or replaced if soiled or excessively worn over time.

BRIEF DESCRIPTION OF THE DRAWINGS

The foregoing and other objects, advantages and features of the invention, and the manner in which the same are accomplished, will become apparent from the following detailed description of the invention taken in conjunction with the accompanying drawings which illustrate preferred and exemplary embodiments and wherein:

FIG. 1 is an environmental view showing an embodiment of the scalp stimulation and cleansing implement in use for cleansing and stimulation of the scalp of a user;

FIG. 2 is a perspective view of an embodiment of the scalp stimulation and cleansing implement of the present invention;

FIG. 3 is a partial section view taken along line 3—3 of FIG. 2;

FIG. 4A is a plan view illustrating the scalp stimulation and cleansing implement in which the cleansing pad is slidably positioned adjacent the stimulation tips;

FIG. 4B is another plan view of the present invention, in which the scalp cleansing pad is slidably positioned at a medial portion of the handle, so as to expose the stimulation tips;

FIG. 4C is yet another plan view of the present invention, in which the scalp cleansing pad is slidably positioned adjacent the wire coil at the second end of the handle;

FIG. 5 is an enlarged, partial perspective view illustrating an alternative embodiment of the cleansing pad, as mounted on the wire stems of the present invention; and FIG. 6 is an enlarged, partial cross-sectional view taken along line 6—6 of FIG. 5.

DESCRIPTION OF THE PREFERRED EMBODIMENTS

Referring now to the drawings, FIG. 1 shows the scalp stimulation and cleansing implement 10 in use by a user U. As illustrated therein, the hand of the user U grasps the handle 11 of the implement 10 at the second end 12 of the handle 11. The first end 13 of the handle is shown extended beneath a hairpiece H on the scalp of the user U.

FIG. 2 shows a preferred embodiment of the scalp stimulation and cleansing implement 10 in which the handle 11 is formed by a plurality, in this case a pair, of wire stems 14 and 15 which extend from a wire coil 16. Preferably, the wire stems 14, 15 are about 9¾ inches long, although various other lengths may be used as desired to provide sufficient length for extension beneath the hairpiece while providing adequate length for being grasped by a user.

Ideally, the wire stems 14, 15 and wire coil 16 are formed of a single section of wire. It has been found that the wire coil may have an inside diameter of about ¾ inch, and that the wire stems and coil 14, 15, 16 may be formed from 0.050 inch, full hard stainless steel, type 304 V, having a tensile strength between 267 and 297. Other materials may be used as desired; however, this material and these dimensions have been found desirable to provide adequate size and flexibility and deformability for allowing the handle 11 formed by the wire stems 14, 15 to extend beneath a hairpiece and for conforming to the rounded shape of the scalp of a user. Likewise, other types of handles may also be used which are sufficiently elongate and flexible for extending beneath the hairpiece and conforming to the scalp of a user.

The wire stems 14, 15 may be substantially parallel; alternatively, they may diverge slightly as they extend from the wire coil 16 toward free ends 20, 21. If the stems 14, 15 diverge, the tips 20, 21 may be separated by a spacing of about 3 inches.

The free ends 20, 21 define the first end 13 of the handle, and the wire coil 16 forms the second end 12 of the handle 11.

Still referring to FIG. 2, stimulation tips 22, 23 extend transverse to the handle 11 and wire stems 14, 15. Preferably, the transverse tips are oriented so that they extend generally downwardly, i.e., in a roughly vertical direction when the handle 11 is held generally horizontal by the user, so that the tips 22, 23 may engage the scalp of the user when the implement 10 is positioned over the scalp. The stimulation tips 22, 23 may be formed from bent portions of the wire stems 14, 15. In one embodiment, the stimulation tips are about ⅛ inch in length and extend at an angle of about 45° relative to the wire stems 14, 15.

Still referring to FIG. 2, a cleansing pad 24 may be received on the handle 11 and wire stems 14, 15. Preferably, the cleansing pad 24 is removable from the handle 11 and wire stems 14, 15. Also, it is preferable that the cleansing pad 24 be slidably attached to the handle 11 and wire stems 14, 15. To insure adequate slidable and removable attachment of the pad 24 to the stems 14, 15, it has been found desirable that the stems 14, 15 extend through a center portion of the pad 24. Thus, perforations may be provided throughout the length of the pad 24 for receiving the stems 14, 15. Other means for slidably affixing the scalp cleansing pad 24 to the wire stems 14, 15 may be provided.

It has also been found advantageous to provide at least one clip 25, and preferably a plurality of said clips 25, as further means for engaging the pad 24. In a preferred embodiment, each wire stem 14, 15 has an alligator-type clip 25 slidably received thereon for engaging an edge of the pad 24. Ideally, the clips 25 are slidable between the first end 13 and second end 12 of the handle, or, in other words, between the free ends 20, 21 of the stems and the wire coil 16.

The implement 10 may be provided with or without the pad 24 and clips 25 or other pad engagement means. If provided without the pad 24 and clips 25 or other pad engagement means, the implement 10 may be used for stimulation of the scalp without cleansing of the scalp.

Referring to FIG. 3, the clips 25 engage an edge portion of the pad 24 to retain the pad 24 at a desired location on the handle 11. As shown in FIGS. 4A, B and C, the pad 24 may be slidably moved along the length of the handle 11. FIG. 4A illustrates one configuration of the implement 10 in which the pad 24 is slidably positioned near the first end 13 of the handle 11 adjacent the stimulation tips 22 and 23. In this configuration, the cleansing pad 24 conceals the tips 22 and 23 so as to reduce or eliminate the stimulation, or scratching, effect of the tips 22, 23 on the scalp. Further, this configuration permits maximum extension of the pad 24 beneath the hairpiece for cleansing remote areas of the scalp, particularly near the edges of a hairpiece.

Another configuration of the implement 10 is shown in FIG. 4B, in which the pad 24 is positioned slightly behind the stimulation tips 22, 23 so as to expose the tips for stimulation of the scalp. In this configuration, the pad 24 may still be extended underneath the hairpiece for cleansing of the scalp of a user, as shown in FIG. 1. Thus, scalp stimulation by the tips 22, 23 and cleansing with the pad 24 may be accomplished simultaneously.

Yet another configuration of the implement 10 is shown in FIG. 4C. Here, the cleansing pad 24 is slidably moved to a position near or adjacent the second end 12 of the handle 11, which in this embodiment is defined by the wire coil 16 from which the wire stems 14, 15 extend. In this configuration, the scalp stimulation tips 22, 23 are well exposed for engagement upon the scalp of a user for relieving itching or other discomfort. Meanwhile, the pad 24 is removed from stimulation tips 22, 23, so that the pad 24 is not in use. This embodiment may be used when stimulation without cleansing is desired. Of course, the pad 24 may also be removed from the handle 11 if stimulation without cleansing is desired.

In the embodiment illustrated in FIGS. 2 and 3, the cleansing pad 24 is substantially flat and circular in shape. An alternate form of the pad is illustrated in FIGS. 5 and 6, in which the pad 24 is substantially flat and semi-circular, or u-shaped. Other shapes may be used for the pad 24. However, it has been found important that the pad should be substantially flat so as to be inserted easily between the hairpiece and scalp. Ideally, the pad 24 should have a thickness of about one-quarter inch, although greater or lesser thicknesses may be used without deviating from the spirit of the invention.

The embodiment of the pad 24 illustrated in FIGS. 2 and 3 is made of a two-ply cloth material. Perforations 26 may be provided at the edges of the cloth material for permitting the wire stems 14, 15 to extend through the pad 24. Another pad 24, shown in FIGS. 5 and 6, is made of a polyester fiber sponge. Other fibrous pad materials may also be used. In this embodiment, perforations 26 may extend through the body of the sponge material so as to permit the wire stems 14, 15 to extend through the pad 24. The clips 25 may engage the bottom surface of the pad 24 shown in FIG. 4, whereas the upper portions 27 of the clips 25 may be pushed into the pad material that extends above the stems 14, 15.

Other materials may be used to form the pad 24. Multiple ply materials may be used, as may single ply materials. However, it has been found desirable that the pad 24 be made of an absorbent material such as cloth, foam sponge, or a fibrous material such as polyester fiber, so that the pad 24 may be saturated in whole or part by water, soap, alcohol, shampoo or other cleansing fluids or solutions. Further, it is desirable that the pad 24 be easily removable from the handle 11 such as stems 14, 15 for cleaning if soiled from use, or for periodic replacement.

In one preferred embodiment, the cloth pad 24 may be about 2½ inches in diameter. Alternatively, the polyester fiber pad 24 may be about 3 inches in length and 2½ inches in width. Other dimensions, sizes and shapes may be used as desired.

To facilitate insertion of the implement 10 between a hairpiece and a scalp of a user, the clips 25 may be rotated to a sideways position relative to the position shown in FIG. 2 so as to minimize the thickness of the implement 10. This is particularly significant to users of hair replacements within the first few days after the replacement has been tightened to the scalp of the user, since the spacing between the hair replacement and the scalp is minimal.

In the drawings and specification, there have been disclosed typical preferred embodiments of the invention. Although specific terms have been employed, they have been used in a generic and descriptive sense only and not for purposes of limitation, the scope of the invention being set forth in the following claims.

What is claimed is:

1. An implement for stimulating and cleansing the scalp of a user, comprising:

a wire coil;

a pair of laterally spaced apart, flexible elongate wire stems extending from said coil, each said wire stem having a free end away from said coil;

a scalp stimulation tip extending transverse to said wire stems at said free end of each said stem, said stimulation tips comprising bent portions of said wire stems; and a scalp cleansing pad slidably received on said wire stems so as to be movable between a first position on said stems adjacent said free ends in which said cleansing pad conceals said tips, and a second position on said stems between said coil and said free ends, in which said tips are exposed, whereby a user may manually grasp said elongate stems near said coil for moving said free ends of said wire stems beneath a hairpiece.

2. A scalp stimulating and cleansing implement as described in claim 1 wherein said elongate wire stems are substantially parallel.

3. A scalp stimulating and cleansing implement as described in claim 1 wherein said elongate wire stems diverge from said wire coil to said free ends.

4. A scalp stimulating and cleansing implement as described in claim 1 wherein each said scalp stimulation tip is a portion of wire about ⅛ inch long and which is bent at about 45° relative to said elongate wire stems.

5. A scalp stimulating and cleansing implement as described in claim 1 wherein said scalp cleansing pad is removably received on said wire stems.

6. A scalp stimulating and cleansing implement as described in claim 5 further comprising clips mounted on said wire stems for retaining said scalp cleansing pad on said stems.

7. A scalp stimulating and cleansing implement as described in claim 6 wherein said clips are slidably mounted on said stems.

8. A scalp stimulation and cleansing implement as described in claim 6 wherein said clips are rotatably mounted on said stems so as to ease insertion of the implement between a hairpiece and scalp.

9. A scalp stimulating and cleansing implement as described in claim 5 wherein said scalp cleansing pad is cloth.

10. A scalp stimulating and cleansing implement as described in claim 5 wherein said scalp cleansing pad is a foam sponge.

11. A scalp stimulating and cleansing implement as described in claim 5 wherein said scalp cleansing pad is a polyester fiber sponge.

12. A scalp stimulating and cleansing implement as described in claim 5 wherein said cleansing pad is substantially circular and flat.

13. A scalp stimulating and cleansing implement as described in claim 5 wherein said cleansing pad is substantially semicircular and flat.

14. A scalp stimulating and cleaning implement as described in claim 5 further comprising perforations through said pad for slidably receiving said wire stems.

15. An implement for stimulating and cleansing the scalp of a user, comprising:

a wire coil;

a pair of laterally spaced apart, substantially parallel and flexible elongate wire stems extending from said coil, each said wire stem having a free end away from said coil;

a scalp stimulation tip extending transverse to said wire stems at said free end of each said stem, said stimulation tips comprising bent portions of said wire stems;

a scalp cleansing pad slidably received on said wire stems so as to be movable between a first position on said stems adjacent said free ends, in which said cleansing pad conceals said tips, and a second position on said stems between said coil and said free ends, in which said tips are exposed; and an alligator clip slidably received on each said wire stem for engaging said pad, whereby a user may manually grasp said elongate stems near said coil for moving said free ends of said wire stems beneath a hairpiece.

16. A scalp stimulating and cleansing implement as described in claim 15, further comprising perforations within said pad for slidably receiving said wire stems.

17. A scalp stimulating and cleansing implement as described in claim 16, wherein said cleansing pad is a substantially flat and semicircular foam sponge.

18. A scalp stimulating and cleansing implement as described in claim 16, wherein said cleansing pad is a substantially flat and semicircular polyester fiber sponge.

19. A scalp stimulating and cleansing implement as described in claim 16, wherein said cleansing pad is a substantially flat and circular cloth.

* * * * *